United States Patent [19]

Randolph

[11] Patent Number: 4,993,959

[45] Date of Patent: Feb. 19, 1991

[54] GROUNDING CLIP

[75] Inventor: Kurt A. Randolph, Etters, Pa.

[73] Assignee: AMP Incorporated, Harrisburg, Pa.

[21] Appl. No.: 467,817

[22] Filed: Jan. 19, 1990

[51] Int. Cl.[5] ..... H01R 4/18; H01R 11/22

[52] U.S. Cl. ..... 439/92; 439/855; 439/881; 439/865

[58] Field of Search ..... 439/92, 881, 867, 855, 439/865

[56] References Cited

U.S. PATENT DOCUMENTS

| | | | |
|---|---|---|---|
| 3,686,609 | 8/1972 | Hansen | 439/92 |
| 3,910,663 | 10/1975 | Winger | 439/92 |
| 4,029,384 | 6/1977 | Reinwall, Jr. | 339/98 |
| 4,659,869 | 4/1987 | Busby | 174/35 GC |
| 4,874,336 | 10/1989 | Marsh | 439/607 |

FOREIGN PATENT DOCUMENTS

| | | | |
|---|---|---|---|
| 2014494 | 10/1970 | Fed. Rep. of Germany | 439/865 |
| 907316 | 10/1962 | United Kingdom | 439/881 |
| 936573 | 9/1963 | United Kingdom | 439/865 |

*Primary Examiner*—Gary F. Paumen

*Attorney, Agent, or Firm*—Robert W. Pitts

[57] ABSTRACT

A grounding clip forming an electrical interconnection between a ground wire and an electrically conductive panel, such as used on an electrical appliance, is disclosed. This grounding clip comprises a stamped and formed member having a U shaped section with opposed walls extending from a bight for engagement with a panel. Tines or serrations are struck inwardly from each wall to grip the panel. A wire contact section is offset from the U shaped panel. A centrally disposed strain relief arm extends from the U shaped section and any force transmitted from the wire to the clip is in the form of a straight pull extending through the centrally disposed strain relief arm.

7 Claims, 6 Drawing Sheets

2
28
20
22
18
18
24

Fig. 9
PRIOR ART
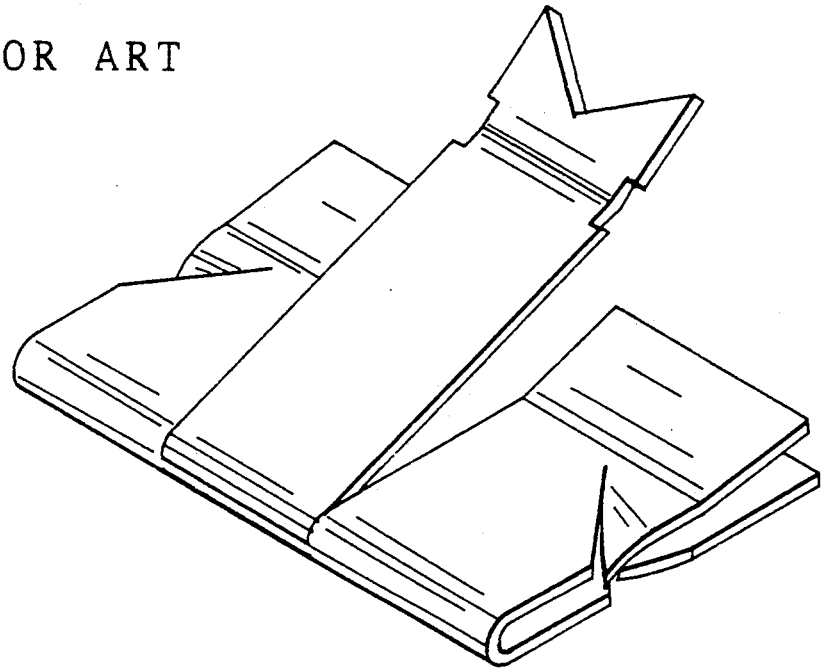
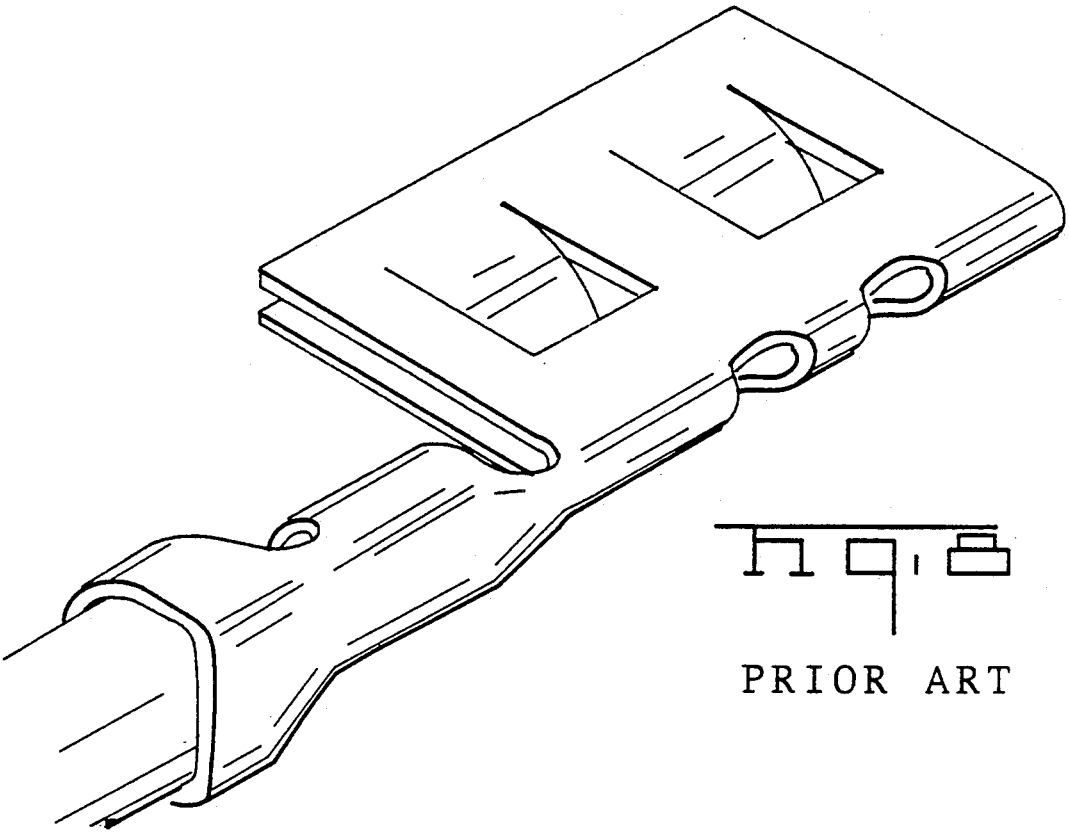
Fig. 8
PRIOR ART

GROUNDING CLIP

BACKGROUND OF THE INVENTION

1. Field of the Invention

This application relates to a grounding clip for use in establishing an interconnection between a wire and a metallic panel such as a panel used in an electrical appliance. 2. Description of the Prior Art A common way in which components of an electrical assembly are grounded is to attach a ground wire to a metallic portion of the chassis. Often this interconnection is made to a metal panel such as a 0.022 inch thick aluminum panel, a 0.024 inch painted steel panel or a 0.033 inch galvanized steel panel. These grounding connections are conventionally made using a prior art grounding clip which comprises a U shaped terminal having a crimp barrel extending from one side edge of the bight or central section of the U shaped clip. The prior art clip, shown in FIG. 8 has two sidewalls extending upwardly from a central bight. Tabs or inwardly struck from the center of the ground plate and these tabs dig into the opposite sides of the panel. The U shaped grounding clip is simply inserted on one edge of the plate. Since the tabs extending from the central portion of the plate are inclined, these tabs can be deflected during insertion of the clip onto the panel. However, the free edges of the tabs engage the panel to resist retraction.

One problem that can be encountered with these conventional grounding clips having a crimp barrel extending from an outboard edge of the panel contact portion is that a force applied to the wire can cause rotation of the panel contact portion. This rotation makes it easier to pull the grounding clip out of engagement with the panel. In many applications minimum extraction force is a requirement and this prior art configuration tends to limit the extraction force which can be attained with such a device. Alternatively, a force applied to the wire can cause bending of the crimp barrel, thus causing permanent damage to the grounding clip.

In addition to conventional grounding clips used to attach a wire to a panel, other conventional grounding clips have been employed for interconnecting two panels. FIG. 9 shows a prior art grounding clip intended for use between two panels. The grounding clip shown in FIG. 9 includes serrations or tines struck along the edges of the panel contact section as opposed to the tabs struck from the center of the walls of the panel contact sections of the clip shown in FIG. 8. These sheared tines or teeth can establish a good electrical and mechanical connection. The grounding clip shown in FIG. 9, however, is intended only for interconnecting two panels. Note that the arm extending from the center of the U shaped panel contact portion is configured as a beam for engaging an adjacent panel.

The instant invention comprises a grounding clip for attaching a wire to a panel. This grounding clip has a crimp section extending from one edge, but it also has a centrally disposed wire strain relief. Any force applied to the wire will be transmitted directly to the grounding clip through the central strain relief thus resulting in a straight pulling action. This straight pulling action requires greater extraction forces than would be required for conventional grounding clips in which the force is applied through an outboard crimp section resulting in rotation rather than straight pull action.

SUMMARY OF THE INVENTION

This grounding clip is used to form an electrical interconnection between a ground wire and an electrically conductive panel. The grounding clip is stamped and formed and has a U shaped panel contact section having opposed walls which extend upwardly on opposite sides of the central bight. Tines or serrations protrude inwardly from each wall to grip the panel. A wire contact section extends from the panel contact section and includes means for establishing an electrical interconnection to a ground wire. A strain relief arm extends from one of two walls of the panel contact section. The other wall of the panel contact section has a slot from which the strain relief is formed. Any extraction force applied to a wire will be transmitted to the panel gripping section through the centrally disposed strain relief instead of through the offset wire contact section, thus increasing the amount of extraction force needed to remove the grounding clip from the panel.

BRIEF DESCRIPTION OF THE DRAWINGS

FIG. 8 is a view of a prior art grounding clip used to interconnect a wire to a panel.

FIG. 9 is a view of a prior art grounding clip used to interconnect two panels.

DETAILED DESCRIPTION OF THE PREFERRED EMBODIMENT

Figure 1:
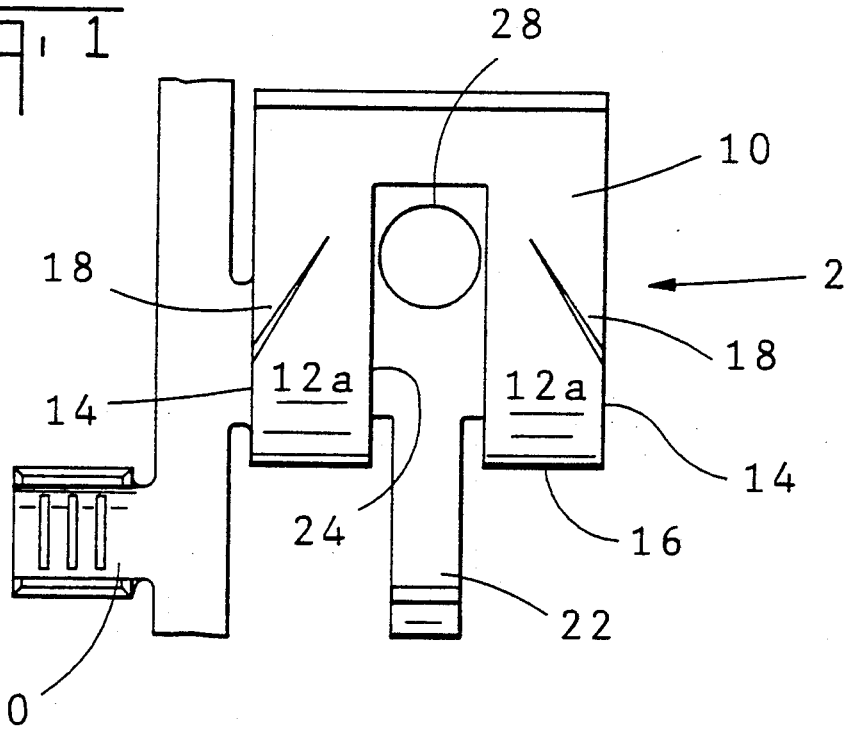
FIG. 1 is a front view of the grounding clip showing the wire crimp section and strain relief section prior to attachment to a wire.
Figure 2:
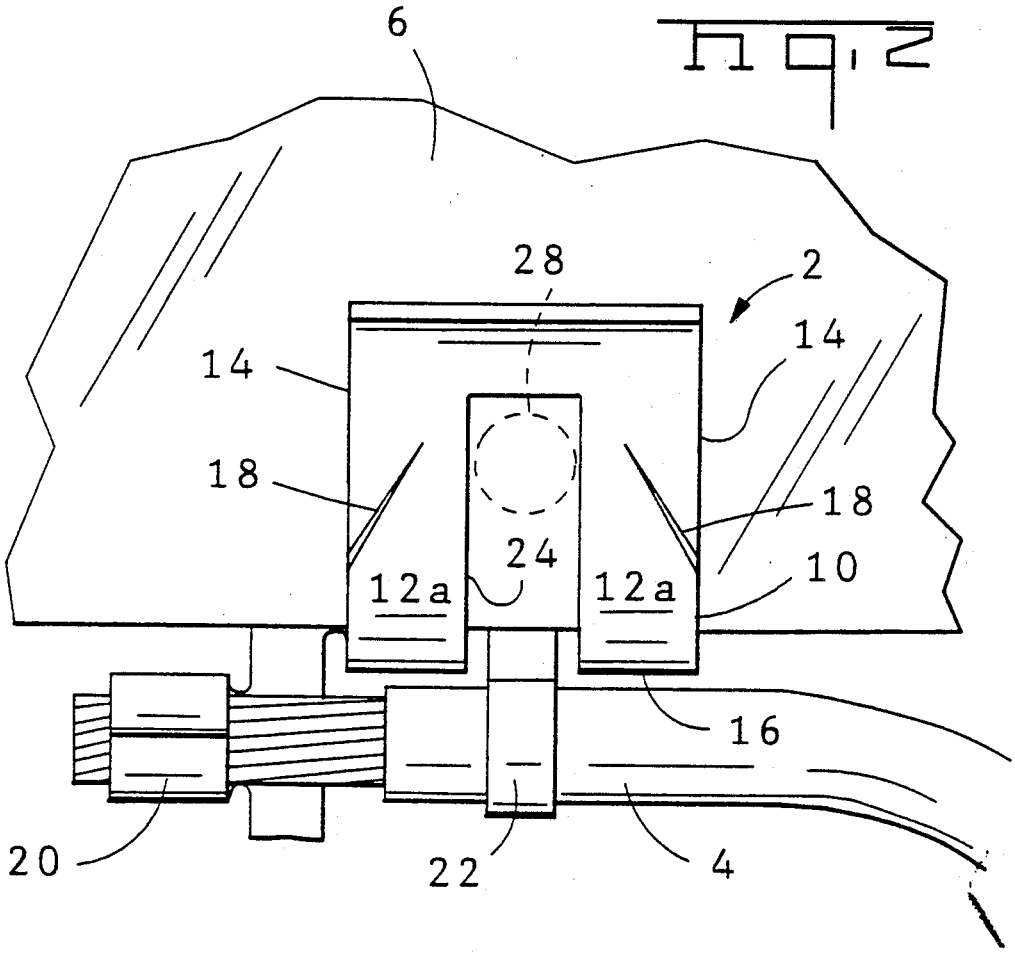
FIG. 2 is a view similar to FIG. 1, but showing a wire attached to the grounding clip with the strain relief crimped around the insulation on the wire and the wire crimp section engaging a stripped free end. This figure also shows the clip engaging a panel.
Figure 3:
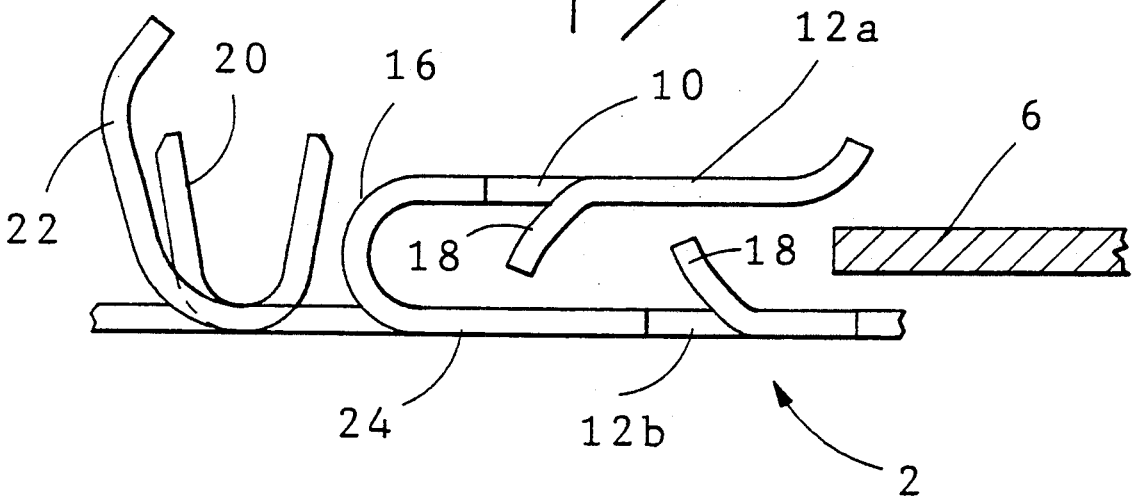
FIG. 3 is an end view of the grounding clip prior to attachment to either a wire or a panel.
Figure 4:
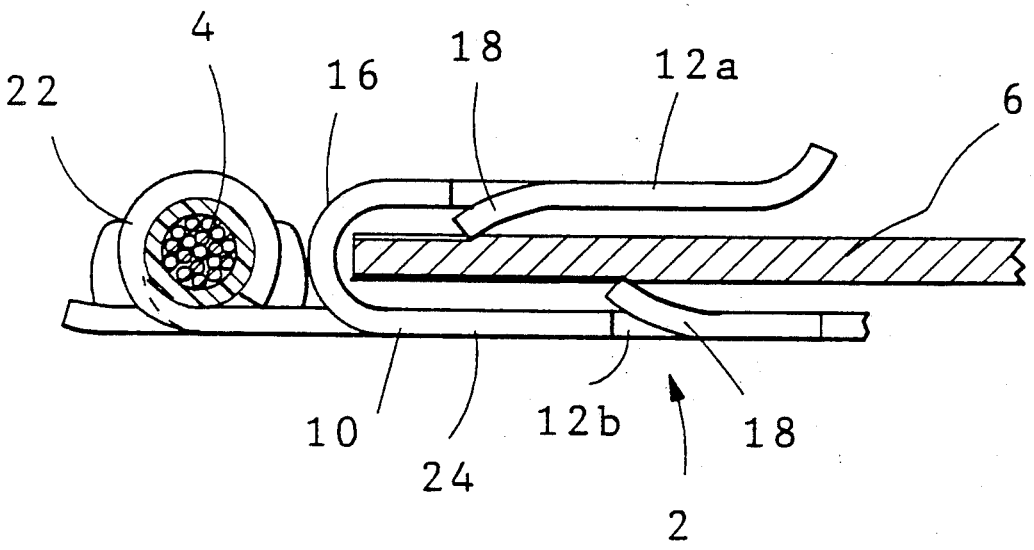
FIG. 4 is a view similar to FIG. 3, but showing the grounding clip attached to both a wire and a panel.
Figure 5:
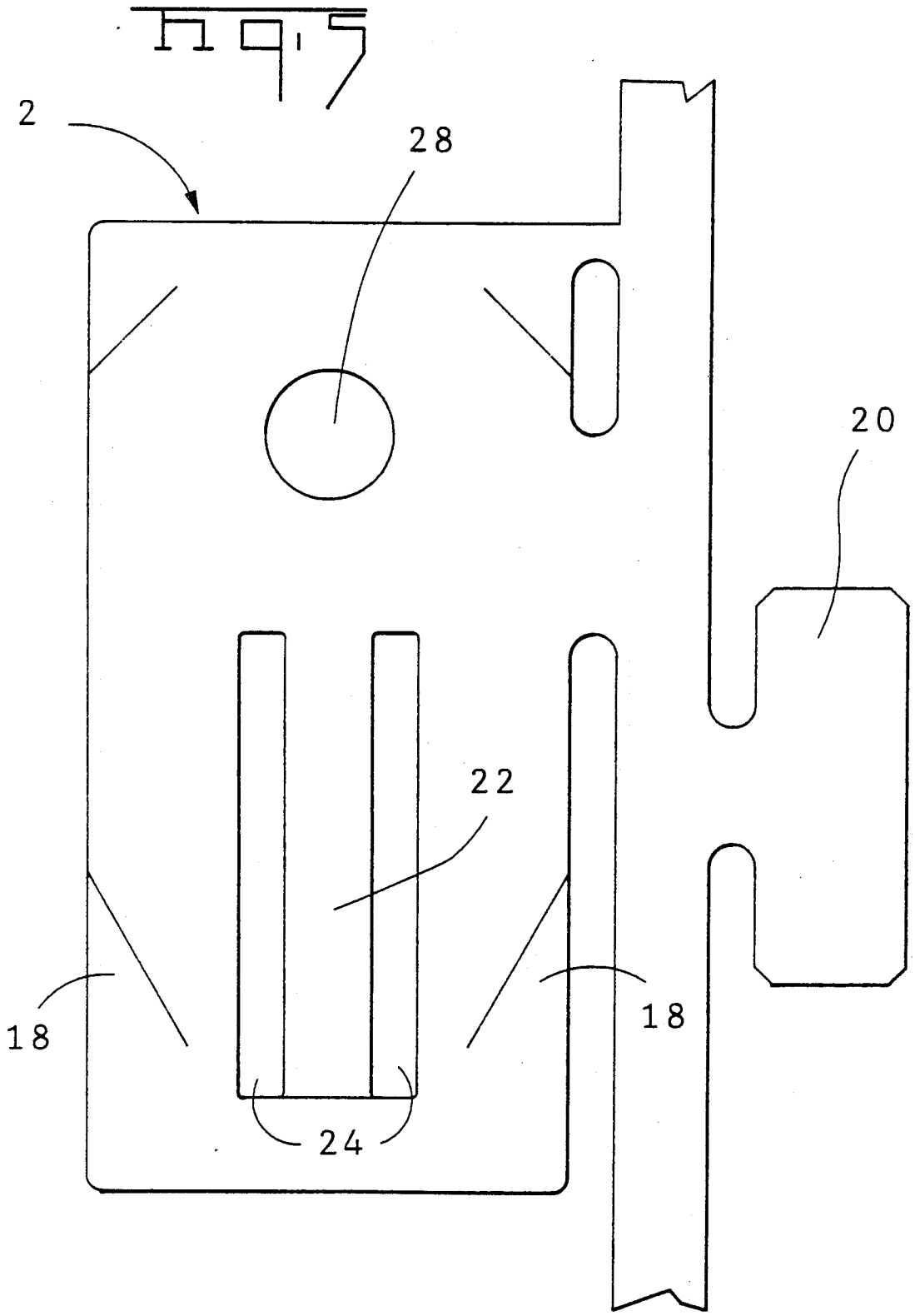
FIG. 5 is a view of the blank of the grounding clip prior to forming.

The grounding clip 2 comprising the preferred embodiment of this invention is intended for forming an electrical interconnection between a ground wire 4 and a panel 6. The grounding clip 2 comprises a stamped and formed member fabricated of a conventional spring metal such as tin plated phosphor bronze. The grounding clip comprising the preferred embodiment of the invention is intended for use with 18 gauge wire, although grounding clips of this type could be used for other wire sizes. The grounding clip comprising the preferred embodiment of this invention is suitable for use with a plurality of different panels having different thicknesses and formed of different materials. In particular, the same grounding clip could be used to establish an interconnection to 0.022 inch thick aluminum panels or 0.024 inch thick painted steel panels, or 0.033 inch galvanized steel panels. It should be understood that not only could the preferred embodiment of this invention be used with other panels, but that this invention, can be fabricated in different sizes and could be employed with panels having more or less thickness and fabricated of different materials.

Grounding clip 2 comprises a U shaped panel contact section 10 and a wire contact section 20. The U shaped panel contact section 10 has a pair of oppositely facing walls 12*a* and 12*b* extending upwardly from a central radiused bight 16. In the preferred embodiment of this invention both electrical and mechanical interconnection to the panel is established by tines or serrations 18 formed inwardly along the edges 14 of the U shaped panel contact section 10. These tines or serrations 18 protrude inwardly from each wall 12 and form an inclined gripping engagement with the panel 6. Each serration is inclined inwardly relative to the walls and extends toward the bight 16. The tabs 18 have a greater retention force when subjected to a straight pull exerted on the U shaped panel contact section 10 than when subjected to a force tending to impart rotation to the U shaped panel contact section 10. The tines or serrations 14 have sharp points which facilitate digging into the panels. Since the tines 18 are inclined towards the bight, the U shaped panel contact section can be inserted onto the edge of a panel 6. During insertion the tines or serrations 18 will be deflected inwardly. It can readily be seen that it would require a greater extraction force to remove the clip 2 from the panel 4 than the force required to insert the clip 2 onto the panel 4.

The U shaped panel contact section 10 also has a strain relief arm 22 which extends from one of the walls 12*b* of the U shaped panel contact section 10. Strain relief arm 22 extends from one of the walls 12 past the bight 16. Strain relief arm 22 extends from the center of the U shaped panel contact section 10 so that a force exerted on the wire to which the strain relief arm is attached, is transferred to the U shaped panel contact section 10 as a straight pull rather than a rotational force. The strain relief arm 22 is struck from a slot 24 extending into the other wall 12*a*. In order to attach the strain relief arm 22, a crimping force is applied to the arm 22 and the arm is crimped around the insulation surrounding the grounding wire 4. Typically, the grounding clip would be applied to the wire 4 before the grounding clip is attached to the panel 6.

The wire contact section 20 comprises a crimp section of conventional construction suitable for establishing an electrical connection to the stripped end of an insulated wire. The wire contact section 20 is disposed below the bight and is located on one side of the U shaped section 10. Forces applied directly to the wire contact section 20 would tend to be transmitted to the U shaped member 10 as a rotational force rather than a straight pull force. As with the strain relief arm 22 the wire contact section 10 comprises a deformable section configured to be crimped around the associated portion of the ground wire. However, when both the wire contact section 20 and the strain relief arm 22 are crimped to the wire, a force applied to the wire will be transmitted first through the strain relief arm directly to the U shaped panel contact section 10 thus resulting in a straight pull action. The straight pull action transmitted through the centrally disposed strain relief arm 22 will increase the extraction force needed to remove the grounding clip 2 from the panel.

Figure 6:
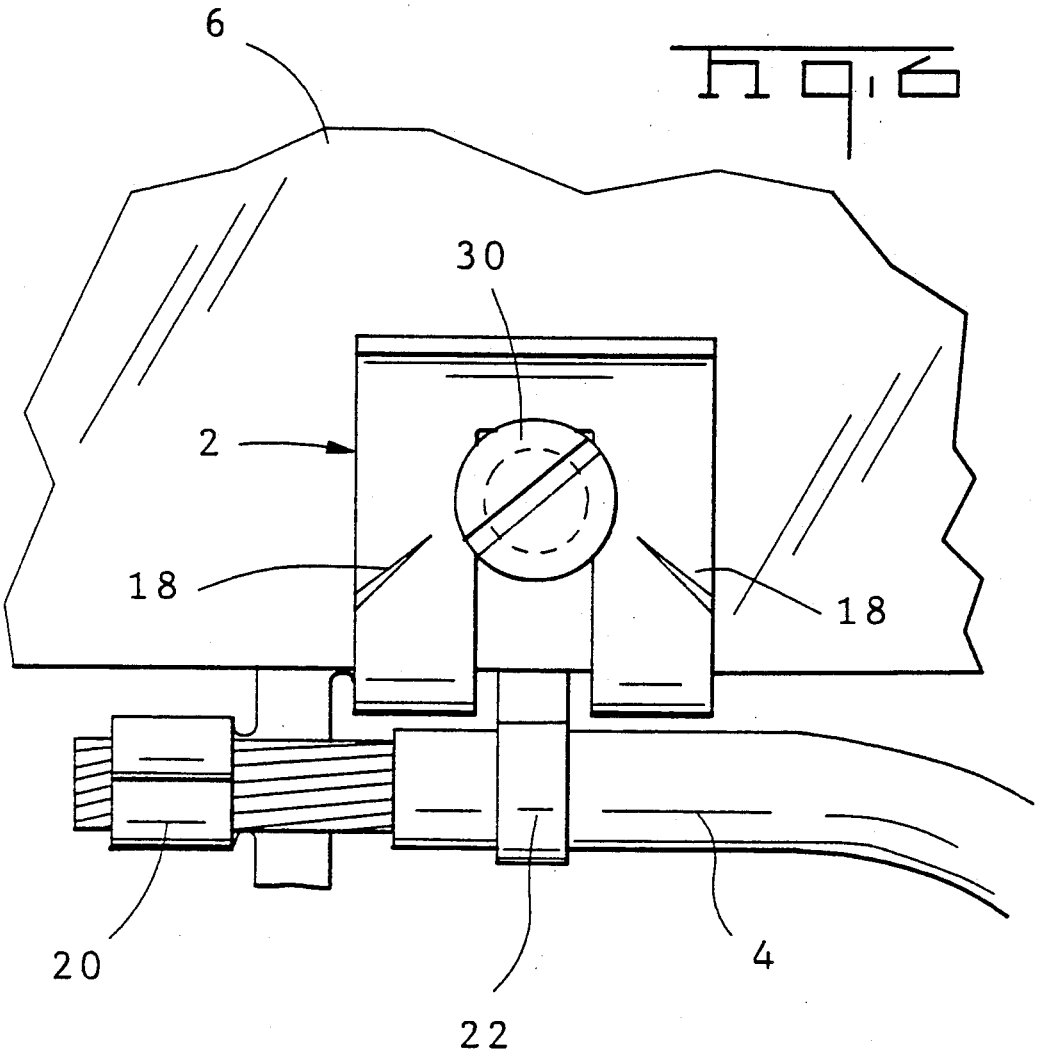
FIG. 6 is a view of the grounding clip used with an auxiliary fastener such as a screw.

FIG. 6 shows an alternate use of this same grounding clip. As shown in FIG. 6, a screw 30 can be used to permanently attach the grounding clip to the panel 6, provided an appropriate clearance hole is located along the edge of the panel 6. The screw can be inserted through the slot 24 when the grounding clip 2 is properly positioned in alignment with the clearance hole in the panel and then tapped into the pilot hole 28. In order to permit the use of a screw, an auxiliary pilot hole 28 is provided in the wall 12*b* from which the strain relief 22 extends. This pilot hole 28 is in alignment with the slot 24 in the opposite wall.

This grounding clip is normally intended for use adjacent the end of a ground wire. However, since both the wire contact section 20 and the strain relief arm 22 are offset from the U shaped panel receiving slot, this grounding clip 2 can be used with a center strip and through wire.

Figure 7A:
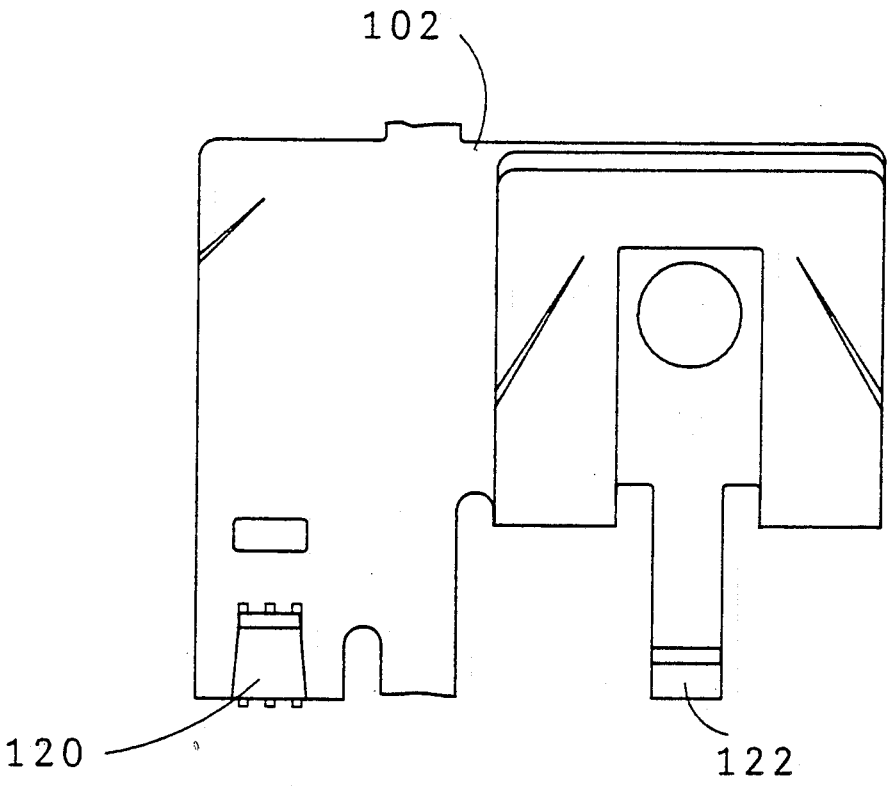
FIGS. 7A and 7B show an alternate embodiment of the invention depicting the use of a different wire barrel.
Figure 7B:
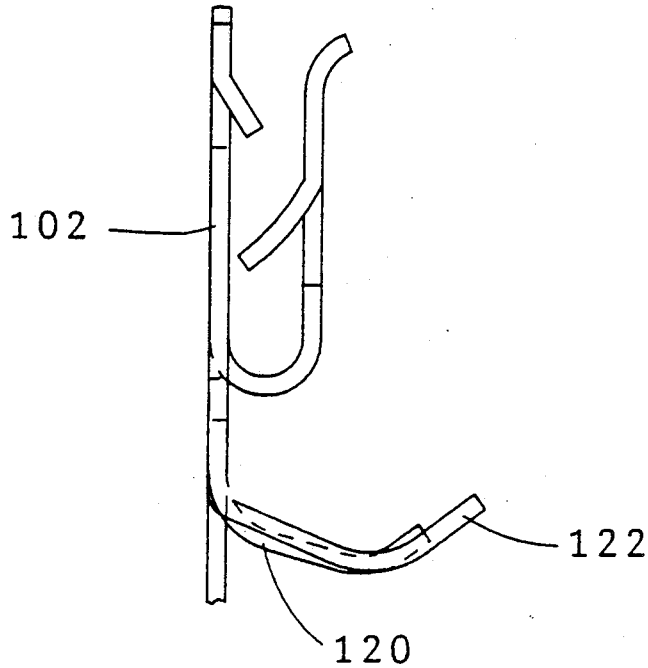

This invention is not limited to the embodiment of FIGS. 1–6. Grounding clip 102 shown in FIGS. 7A and 7B functions in the same manner, but this embodiment has a different wire contact section 120. Other configurations embodying this invention would be apparent to one of ordinary skill in the art.

I claim:

1. A grounding clip for forming an electrical interconnection between a ground wire and an electrically conductive panel, the grounding clip comprising a stamped and formed member having a U-shaped section with opposed walls extending from a bight; tines protruding inwardly from each wall for gripping the panel; a wire contact section for establishing an electrical interconnection with the ground wire, and a strain relief arm extending from one said wall on the side of the bight opposites said walls, the other said wall having a slot from which the strain relief arm is formed, and wherein the free ends of the tines are inclined relative to the walls and extend toward the bight, the tines having a greater retention force when subjected to a straight pull exerted on the U-shaped section than when subjected to a force tending to impart rotation to the U-shaped section.

2. The grounding clip of claim 1 wherein the strain relief arm extends from the center of the U-shaped section so that a force exerted on the wire is transferred to the U-shaped section as a straight pull.

3. The grounding clip of claim 2 wherein the tines comprise portions struck inwardly from the edges of the walls.

4. The grounding clip of claim 2 wherein the wire contact section comprises a crimp section.

5. The grounding clip of claim 2 wherein the wire contact section is disposed below the bight and on one side of the U-shaped section so that a force exerted on the wire contact section is transmitted as a rotary force to the U-shaped member.

6. The grounding clip of claim 6 wherein the strain relief arm and the wire contact section comprise deformable members configured to be crimped around associated portions of the ground wire.

7. The grounding clip of claim 6 wherein the one wall has a pilot hole aligned with the slot in the other wall so that a screw can be inserted through the slot when the grounding clip is properly aligned with a clearance hole in the panel and then tapped into the pilot hole.

* * * * *